US010208423B2

(12) United States Patent
Jung et al.

(10) Patent No.: US 10,208,423 B2
(45) Date of Patent: Feb. 19, 2019

(54) LAUNDRY TREATING APPARATUS HAVING DETERGENT INSERT DOOR

(71) Applicant: LG ELECTRONICS INC., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 67 days.

(21) Appl. No.: 15/398,936

(22) Filed: Jan. 5, 2017

(65) Prior Publication Data

US 2017/0191210 A1 Jul. 6, 2017

(30) Foreign Application Priority Data

Jan. 5, 2016 (KR) ..... 10-2016-0001208

(51) Int. Cl.

| | |
|---|---|
| ***D06F 39/14*** | (2006.01) |
| ***D06F 39/02*** | (2006.01) |
| *D06F 39/12* | (2006.01) |
| *E05F 1/12* | (2006.01) |

(52) U.S. Cl.

CPC ..... *D06F 39/14* (2013.01); *D06F 39/02* (2013.01); *D06F 39/022* (2013.01); *D06F 39/12* (2013.01); *E05F 1/1215* (2013.01); *E05F 1/1284* (2013.01); *E05Y 2900/312* (2013.01)

(58) Field of Classification Search

CPC ..... D06F 39/02; D06F 39/022; D06F 39/12; D06F 39/14

See application file for complete search history.

(56) References Cited

U.S. PATENT DOCUMENTS

| | | | | |
|---|---|---|---|---|
| 2010/0161143 | A1* | 6/2010 | Smith | A47L 15/4418 700/283 |
| 2011/0062837 | A1 | 3/2011 | Kim et al. | |
| 2011/0174021 | A1 | 7/2011 | Lee et al. | |
| 2014/0075684 | A1* | 3/2014 | Kim | D06F 39/02 8/137 |

(Continued)

FOREIGN PATENT DOCUMENTS

| | | |
|---|---|---|
| CN | 202347299 | 7/2012 |
| CN | 103668888 | 3/2014 |

(Continued)

OTHER PUBLICATIONS

PCT International Search Report dated Jan. 25, 2017 issued in Application No. PCT/KR2016/012807.

(Continued)

*Primary Examiner* — Joseph L. Perrin
(74) *Attorney, Agent, or Firm* — Ked & Associates, LLP

(57) ABSTRACT

A laundry treating apparatus includes a detergent insert door rotatably provided on a front surface of a detergent container receiving portion to open or close the detergent container receiving portion, wherein the detergent insert door includes a bracket coupled to the front opening portion to allow a detergent inlet formed on a front surface thereof to communicate with the front opening portion, and including a hinge receiving portion; a cover inserted into the hinge receiving portion and coupled to the bracket; a shaft damper coupled to a hinge shaft at one side of the bracket; and an elastic member supported by the bracket and the cover.

12 Claims, 12 Drawing Sheets

(56) References Cited

U.S. PATENT DOCUMENTS

| | | | | |
|---|---|---|---|---|
| 2014/0076008 | A1* | 3/2014 | Jo | D06F 39/02 68/17 R |
| 2014/0076009 | A1* | 3/2014 | Kim | D06F 39/02 68/17 R |

FOREIGN PATENT DOCUMENTS

| | | |
|---|---|---|
| CN | 104641031 | 5/2015 |
| DE | 202 16 589 | 1/2003 |
| EP | 2708633 | 3/2014 |
| FR | 2470230 | 5/1981 |
| FR | 2 894 994 | 6/2007 |
| KR | 20-1993-0004906 | 3/1993 |
| KR | 10-2010-0108060 | 10/2010 |
| KR | 10-2011-0083833 | 7/2011 |
| KR | 10-2014-0065858 | 5/2014 |
| KR | 10-2015-0008035 | 1/2015 |
| WO | WO 2013/136238 | 9/2013 |

OTHER PUBLICATIONS

European Search Report dated Mar. 2, 2017 issued in Application No. 16 205 056.1.

Chinese Office Action (with English translation) dated Aug. 8, 2018 issued in CN Application No. 201710006432.7.

* cited by examiner

LAUNDRY TREATING APPARATUS HAVING DETERGENT INSERT DOOR

CROSS-REFERENCE TO RELATED APPLICATION(S)

Pursuant to 35 U.S.C. § 119(a), this application claims the benefit of the earlier filing date and the right of priority to Korean Application No. 10-2016-0001208, filed on Jan. 5, 2016, the contents of which is incorporated by reference herein in its entirety.

BACKGROUND

1. Field

The present disclosure relates to a laundry treating apparatus having a door covering a detergent supply apparatus.

2. Background

A laundry treating apparatus may allow clothes, bedding, and the like (hereinafter, referred to as laundry) to be placed into a drum to remove contamination on laundry. The laundry treating apparatus may perform the processes of washing, rinsing, dehydration, drying, and the like. The laundry treating apparatus may include a body that forms an external appearance, a tub accommodated into the body, a drum rotatably mounted within the tub to put laundry thereinto, and a detergent supply apparatus configured to supply detergent into the drum.

The laundry treating apparatus may be divided into a top loading type and a front loading type based on how laundry is placed into the drum. A front loading type washing machine may be a drum washing machine, and in recent years, a drum washing machine having an additional sub-drum at a lower end of the body to wash a small amount of laundry as well as a drum washing machine having only one drum in the body have been marketed and used.

In the related art, the drum washing machine is typically configured in such a manner that a detergent inlet is located at an upper portion of the body, and a detergent insert container is taken out by pulling out the detergent inlet to withdraw it to a front surface of the body. However, through such a method, it may be difficult to supply a large amount of detergent through the detergent inlet, and the detergent dispenser is located at an upper side of the drum in the body on which the line of sight is focused and thus not aesthetically pleasing.

In a drum washing machine according to the present disclosure, a detergent container receiving portion receiving a container holding detergent in a liquid phase may be located at a lower portion of the washing machine to supply detergent required for the washing process to the drum. The detergent container receiving portion may be divided into a detergent container inlet into which a detergent container is inserted and a filter inlet into which a filter is inserted, and a detergent insert door may be provided on the laundry treating apparatus, thereby allowing a user to open or close the inlets as needed.

Even in the related art, a detergent inlet may be located at a lower portion of the body, but detergent being supplied to the drum in a drawing manner of withdrawing a detergent container and a frame having the same through a grip other than a manner of opening or closing a detergent insert door to insert the detergent container, and a method of mounting the detergent container through a rail located at a lower portion or lateral surface of the frame may be used.

As illustrated in the present disclosure, when a method of inserting the detergent container at a lower portion of the laundry treating apparatus is employed, the detergent insert door may be provided near the floor, and the detergent insert door may be bumped against the floor as the detergent insert door is opened to cause scratches or damage as well as generating noise while being bumped. Furthermore, the detergent insert door may be damaged due to being stepped on by the user's foot.

In order to solve the foregoing problem, the need of a detergent insert door configured to be opened only up to a predetermined angle even when the detergent insert door is opened to thereby be located and separated from the floor by a predetermined distance is required. The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein:

FIG. 5 is a side view in which FIG. 4 is seen from one side;

FIG. 10 is a cross-sectional view in which FIG. 9 is cut in a horizontal direction;

FIG. 14 is a side view in which FIG. 13 is seen from one side.

DETAILED DESCRIPTION

Figure 1:
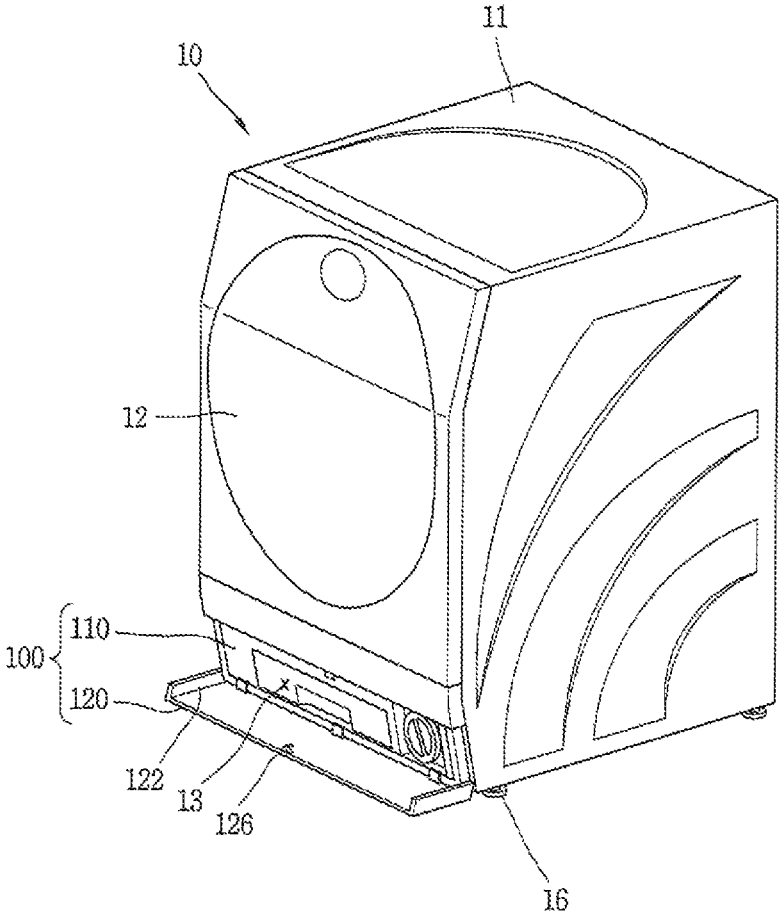
FIG. 1 is a perspective view illustrating a laundry treating apparatus including a detergent insert door.
Figure 2:
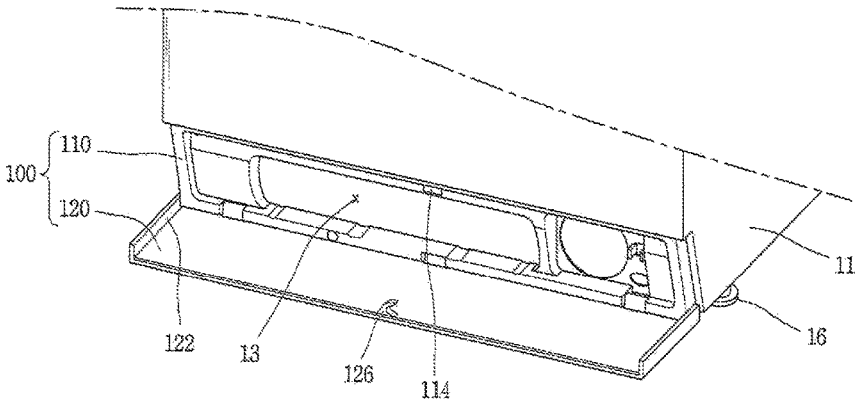
FIG. 2 is a perspective view illustrating a shape in which a detergent insert door is opened.
Figure 3:
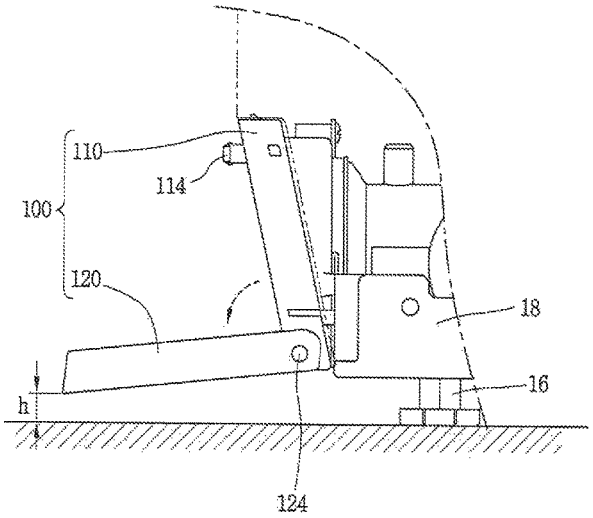
FIG. 3 is a side view in which the detergent insert door in FIG. 2 is seen from one side.
Figure 4:
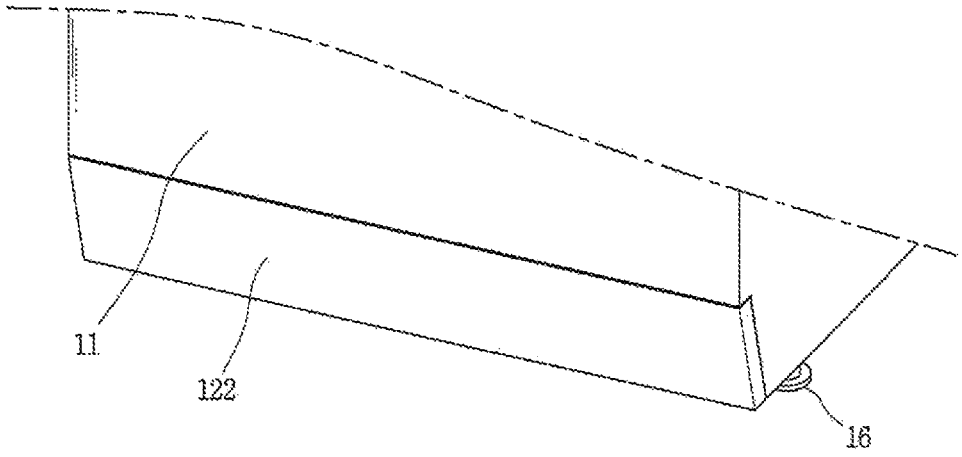
FIG. 4 is a perspective view illustrating a shape in which a detergent insert door is closed.

Referring to FIGS. 1-3, the laundry treating apparatus may include a body 11 configured to form an appearance, a drum rotatably mounted within the body 11 to receive laundry, a detergent container receiving portion (or detergent container receiving compartment) 18 configured to receive a detergent container to supply detergent to the drum, and a body supporting member (or leg) 16 configured to support the body 11 from the bottom. Furthermore, the laundry treating apparatus may have a detergent insert door 100 located on a front surface of the detergent container receiving portion 18.

The detergent insert door 100 may open or close the detergent container receiving portion 18 as the cover 120 rotates with respect to the bottom. The detergent insert door 100 rotates the cover 120 to open the detergent container receiving portion 18 and then inserts the detergent container into the detergent container receiving portion 18.

The detergent insert door 100 may include a bracket 110 and a cover 120, and the bracket 110 may be coupled and fixed to a front opening portion of the detergent container receiving portion 18. The cover 120 may be hinge-coupled to the bracket 110 at a lower portion thereof, and thus rotatably installed. The cover 120 may rotate on a front surface of the detergent container receiving portion 18 to open and close a detergent inlet 13 communicating with a front opening portion of the detergent container receiving portion 18. When the cover 120 is opened to open the detergent inlet 13, the cover 120 may rotate at one side of the detergent inlet 13 coupled to the bracket 110. The cover 120 may include a hinge coupling portion (or hinge) 125 hinge-coupled to the bracket 110 at a lower portion thereof, and thus the cover 120 may rotate to a predetermined angle with respect to the bracket 110.

In a typical detergent insert door 100, a shaft damper 130 and a elastic member (or spring) 140 may not exist, and when the cover 120 rotates at a high speed toward the floor due to the opening of the detergent insert door 100 scratches or damage may be caused, and unwanted noise may be generated due to the opening of the detergent insert door 100. Furthermore, the cover 120 may rotate until it contacts the floor or another object located on the floor without any limited angle, and thus a user may feel difficulty to support the cover 120 when he or she closes the cover 120.

The detergent insert door 100 may be formed by coupling the cover 120 to the bracket 110, wherein the shaft damper 130 and elastic member 140 are used in the coupling. For the shaft damper 130, when an upper portion of the cover 120 rotates with respect to the bracket 110, the cover 120 may rotate at a predetermined speed by a resistance of oil located within the shaft damper 130.

A rotation speed of the cover 120 may be determined according to the shaft damper 130, and the rotation speed of the cover 120 is determined according to the characteristics of oil in a cylinder within the shaft damper 130. When the cover 120 is opened, the cover 120 may rotate at a predetermined speed by the shaft damper 130, and when rotated more than a set predetermined angle, the elastic member 140 located within the detergent insert door 100 may support the cover 120 to provide an elastic force in an opposite direction to the rotation of the cover 120.

FIG. 3 illustrates a scenario in which the cover 120 rotated toward the floor by a predetermined angle be separated from the floor by a predetermined height (h). The body supporting member 16 may support the body from the bottom by a predetermined distance. The cover 120 may rotate from the bracket 110 by a predetermined angle, and then receive an elastic force from the elastic member 140 in an direction opposite to a rotating direction of the cover 120 to limit the cover 120 from being rotated above a predetermined angle. As a result, the cover 120 may have a predetermined height from the floor, thereby solving the foregoing problem that occurs when the cover 120 of the detergent insert door 100 is brought into contact with the floor.

Figure 5:
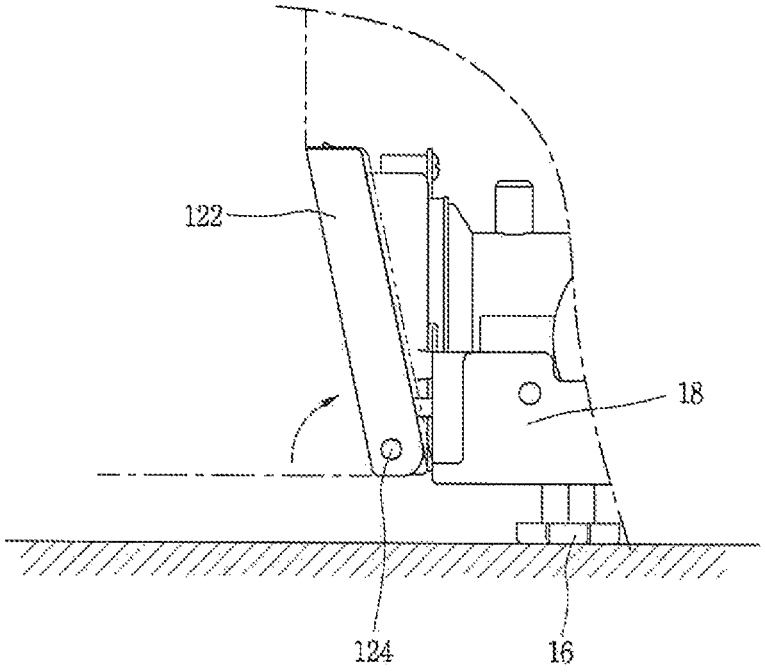

A ring portion (or hook) 126 may be located at an upper end of the cover 120, and the ring portion 126 may be inserted into a ring fastening portion 114 located at an upper portion of the bracket 110, thereby fixing the cover 120 to the bracket 110. When the cover 120 is coupled to the bracket 110, the cover 120 may be located on a front surface of the detergent inlet to block the detergent inlet, thus improving the appearance. As illustrated in FIG. 5, when the cover 120 is opened, an end of the cover 120 may be separated from the floor by a predetermined height, and thus a user may insert his or her finger into a portion having a predetermined height from the floor, and then easily support the cover 120, thereby pulling up the cover 120 and then fixing it to the bracket 110.

The laundry treating apparatus may include the detergent container receiving portion 18, which may be a space into which the detergent container may be inserted. The detergent container receiving portion 18 has a front opening portion on which a front surface is opened. The detergent container may be inserted through the front opening portion.

The detergent insert door 100 may expose the detergent container inlet to an outside or block the detergent container inlet, thereby opening or closing the detergent container receiving portion 18. The detergent insert door 100 may include the cover 120, the bracket 110, the shaft damper 130 and the elastic member 140.

The cover 120 may rotate with respect to the bracket 110 to open or close the detergent container inlet. The cover 120 may be inserted into a hinge receiving portion or groove 111 of the bracket 110 and hinge-coupled to the bracket 110, and rotated around a hinge shaft 124 to open or close the detergent container inlet.

When the cover 120 opens the detergent inlet, the cover 120 may rotate with respect to an axis formed by being hinge-coupled to the bracket 110 by a preset angle, and then rotation above a predetermined angle may be limited by the elastic member 140 supporting the bracket 110 and cover 120. The preset angle may be determined by a user. For example, the elastic member 140 may apply an elastic force to the cover 120 from the time when the cover 120 rotates approximately 60 degrees with respect to the bracket 110.

When the cover 120 and bracket 110 form a larger angle, an amount of elastic force provided by the elastic member 140 may further increase, and thus when the cover 120 rotates approximately 90 degrees with respect to the bracket 110, it may be possible to set a force applied to the cover 120 due to gravity to equate to an elastic force of the elastic member 140. When the cover 120 and the bracket 110 form an angle of about 90 degrees, the user may insert his or her hand below the cover 120, and thus the user may support and then pull up the cover 120 to fix it to the bracket 110.

When the bracket 110 is fastened to the cover 120 by hinge coupling, one side of the shaft damper 130 may be coupled to one side of the cover 120 to limit a rotation speed of the cover 120, thereby limiting the rotation speed of the cover 120. When the cover 120 rotates at a predetermined speed by the shaft damper 130, and then reaches a predetermined angle, the rotation thereof may be limited and supported by the elastic member 140.

The cover 120 may include a first member 121 and a second member 123. The first member 121 may form an appearance of the detergent insert door 100 when viewed from an outside. The first member 121 may have a typical plate shape, but bracket supporting portions (or bracket supports) 122 may be provided at both ends of the first member 121 to protrude the bracket 110.

Figure 7:
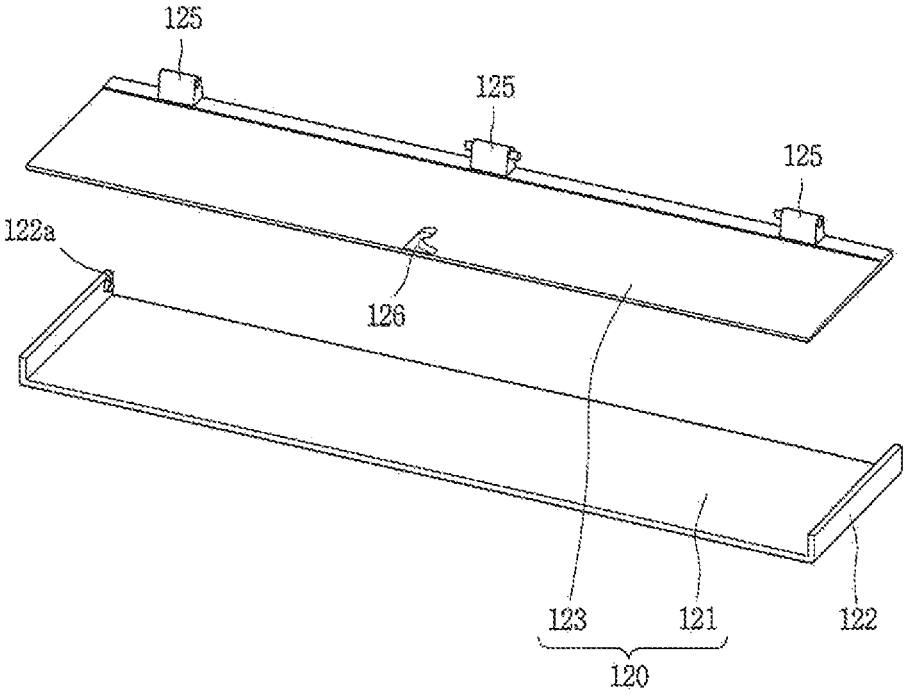
FIG. 7 is a perspective view illustrating a first member and a second member constituting a cover.
Figure 8:
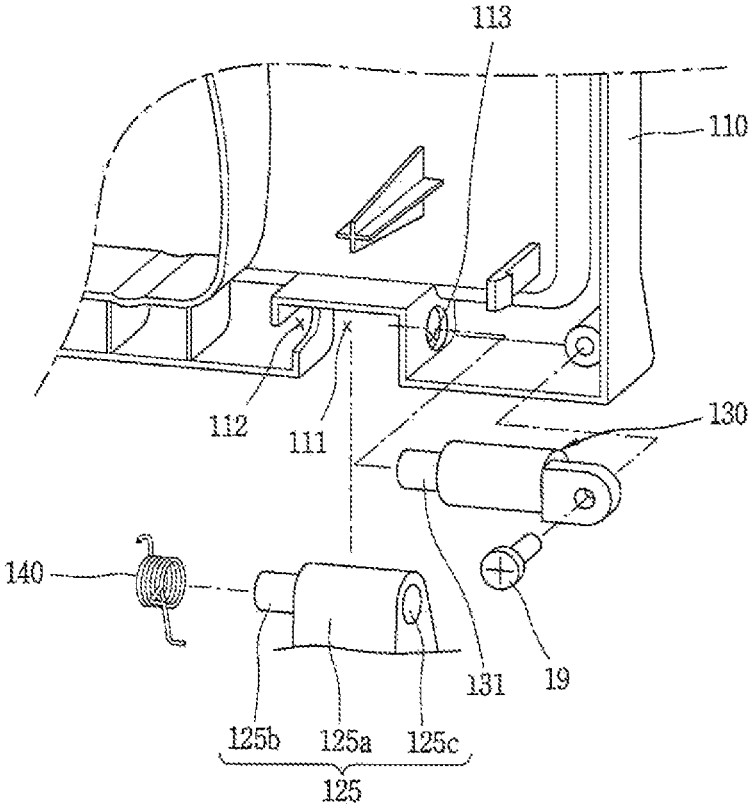
FIG. 8 is a perspective view illustrating a shape in which a hinge coupling portion and a shaft damper are inserted into a rear surface of a bracket.

The bracket supporting portions 122 may support both lateral surfaces of the bracket 110 to allow the appearance of both lateral surfaces of the bracket 110 to be neatly seen. The bracket supporting portion 122 may include a rotation protrusion 122*a* formed toward a central portion of the first member 121 at one side thereof as illustrated in FIG. 7. The rotation protrusion 122*a* may be configured to connect to lateral surface of the bracket 110. When the rotation protrusion 122*a* is accommodated into a rotation protrusion receiving portion 115 located in the bracket 110, the cover 120 may be more efficiently rotated by an action with the rotation protrusion receiving portion 115.

The second member 123 may be adhered to a rear surface of the first member 121 to reinforce a strength of the first member 121. A rib formed on the second member 123 may enhance the strength of the first member 121 coupled to the second member 123, and increase durability. The first member 121 and second member 123 may be adhered and coupled to each other using an adhesive configured with a synthetic resin.

At least one or more hinge coupling portions 125 may be provided at a lower portion of the second member 123, and the hinge coupling portion 125 may be configured with a hinge shaft 124. The hinge coupling portion 125 may protrude toward the detergent container receiving portion 18 from the bottom of the second member 123 to be inserted into the hinge receiving portion 111. Three hinge coupling portions 125 may be formed at a lower portion of the second member 123, but the present disclosure may not be necessarily limited to this, and the hinge coupling portions 125 may be additionally located at a plurality of positions.

The ring portion 126 inserted into the ring fastening portion 114 of the bracket 110 to be fixed to the bracket 110 may be located at an upper portion of the second member 123. When the ring portion 126 is inserted into the ring fastening portion 114 and then a small external force is applied thereto, the ring fastening portion 114 may hold the ring portion 126, and thus the second member 123 may be fixed to the bracket 110.

The hinge coupling portion 125 may be inserted into the hinge receiving portion 111 of the bracket 110 to form a hinge coupling, thereby allowing the cover 120 to rotate with respect to the bracket 110. The hinge coupling portion 125 may include a protruding portion (or housing) 125*a*, a shaft protrusion (or shaft) 125*b*, and a shaft damper protrusion receiving portion or socket 125*c*. The protruding portion 125*a* may be formed to be inserted into the hinge receiving portion 111 to perform the role of a body of the hinge coupling portion 125.

An elastic member supporting portion or notch 125*d* configured in a groove shape to accommodate and support one end of the elastic member 140 may be formed at one side of the protruding portion 125*a*. The shaft protrusion 125*b* may be supported by the bracket 110, and may extend along a direction of the shaft damper 130 at a first side of the protruding portion 125*a* to insert the elastic member 140.

The shaft damper protrusion receiving portion 125*c* may have a groove shape, and may be formed at a second side of the protruding portion 125*a* to accommodate one end of the shaft damper 130. One end of the shaft damper 130 may be inserted into the shaft damper protrusion receiving portion 125*c*, thereby allowing the shaft damper 130 to control a rotation speed of the cover 120 according to the specification of the shaft damper 130 through the hinge coupling portion 125 of the second member 123.

The bracket 110 may be coupled to a front surface of the detergent container receiving portion 18, and the cover 120 may be coupled to the bracket 110 or rotated with respect to bracket 110 to perform the role of opening or closing the detergent container inlet. A shape in which the bracket 110 is coupled to a front surface of the detergent container receiving portion 18 is illustrated in FIGS. 3 and 5. As illustrated in FIGS. 3 and 5, the bracket 110 coupled to a front opening portion of the detergent container receiving portion 18 may be positioned such that an upper portion of the bracket 110 is protrudes further forward with respect to a lower portion of the bracket 110 by a predetermined angle. Thus, when the ring portion 126 located at an upper portion of the cover 120 is released from the ring fastening portion 114 of the bracket 110, the cover 120 may open by force of gravity.

Figure 6:
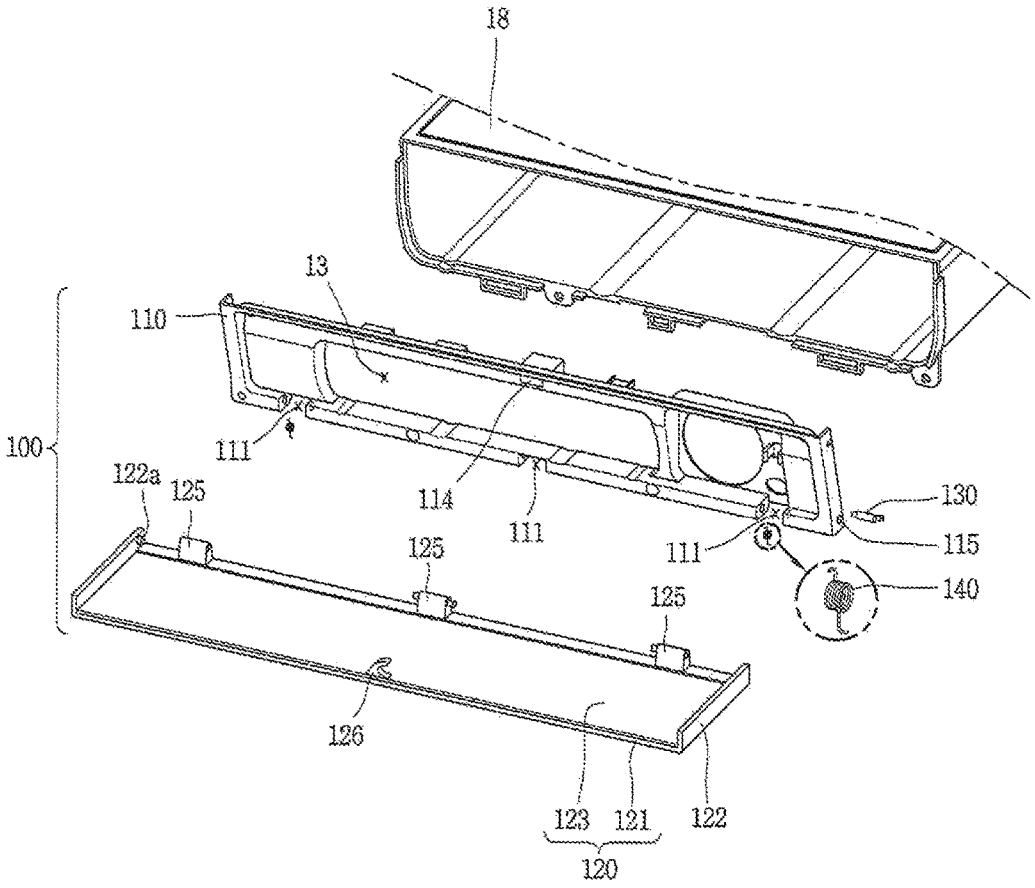
FIG. 6 is an exploded view illustrating each configuration of a detergent insert door.

The hinge receiving portion 111 may be provided at a lower portion of the bracket 110. The hinge receiving portion 111 may have a depressed shape in a direction from the bottom to the top to hinge-couple the cover 120 to the bracket 110. FIG. 6 illustrates a shape in which total three hinge receiving portions 111 are formed on the bracket 110. However, any number of hinge receiving portions may be included.

The bracket 110 may include a plurality of hinge receiving portions 111 at a lower portion thereof. The hinge coupling portion 125 of the second member 123 constituting the cover 120 may be inserted into the hinge receiving portion 111, and thus the hinge receiving portion 111 may be hinge-coupled to the hinge coupling portion 125. Through this, the cover 120 may rotate with respect to a hinge shaft.

The hinge receiving portion 111 may include a cover supporting hole 112 and a shaft damper 130, respectively, at both sides thereof. The cover supporting hole 112 to allow the shaft protrusion 125*b* of the hinge coupling portion 125 to pass therethrough to support and rotate the cover 120 may be supported at a first side of the hinge receiving portion 111, and a shaft damper insert hole 113 formed to receive the shaft damper 130 receiving portion of the hinge coupling portion 125 to allow the shaft damper 130 to pass therethrough is located at a second side of the hinge receiving portion 111.

The shaft damper 130 may be located at a first side of the bracket 110. The bracket 110 may include with a space capable of accommodating the shaft damper 130, and the shaft damper 130 may be located in this space and fixed to the bracket 110 using screw fastening. A screw insert hole into which a screw is inserted and fixed to the bracket 110 may be located at a first side of the shaft damper 130. The shaft damper may be provided in a direction of the hinge shaft 124, and one end of the hinge shaft 124 may be coupled to the shaft damper 130 receiving portion of the hinge coupling portion 125 through the shaft damper insert hole 113 to limit a rotation speed of the cover 120.

Figure 9:
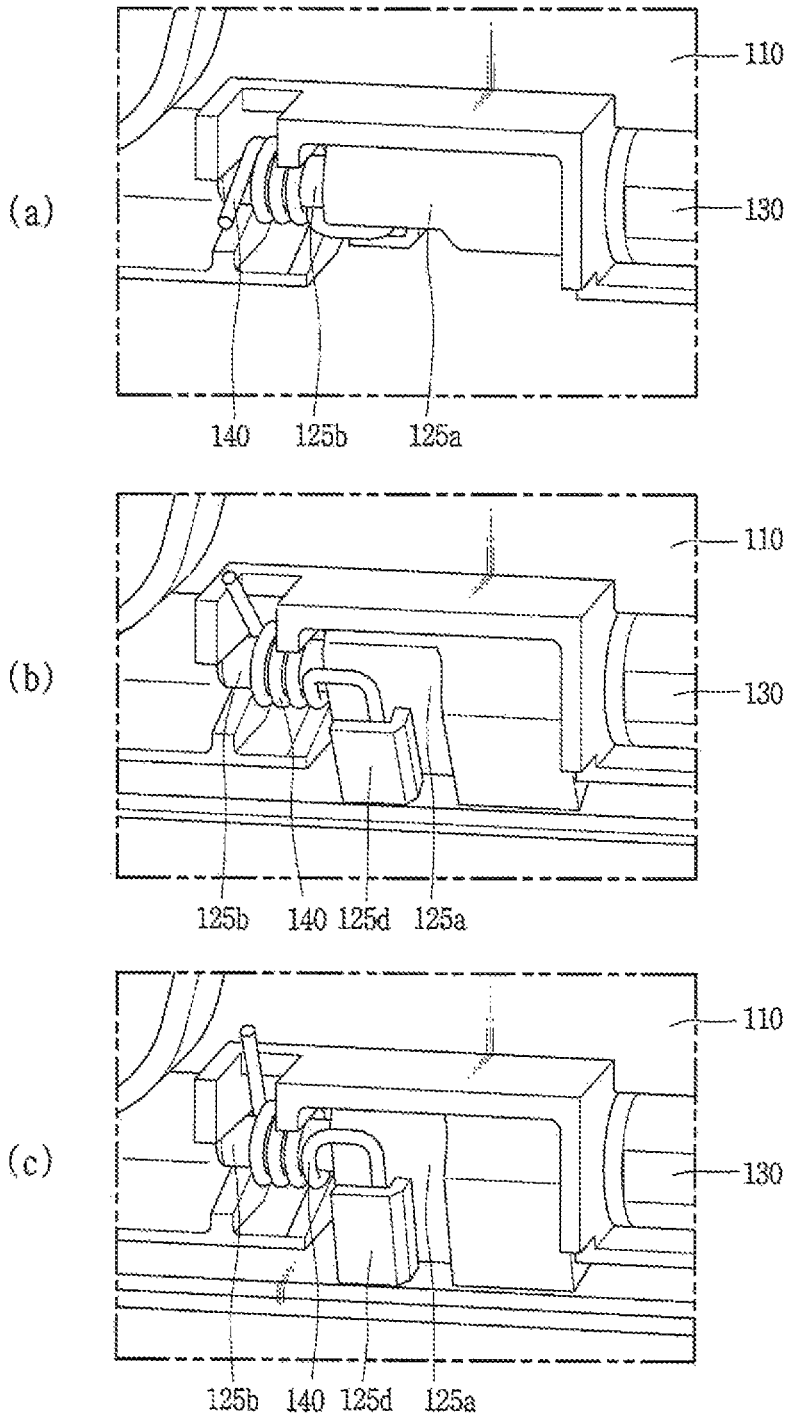
FIG. 9 illustrates a relationship between a hinge coupling portion, an elastic member and a shaft damper located at a hinge receiving portion as a cover rotates.
Figure 10:
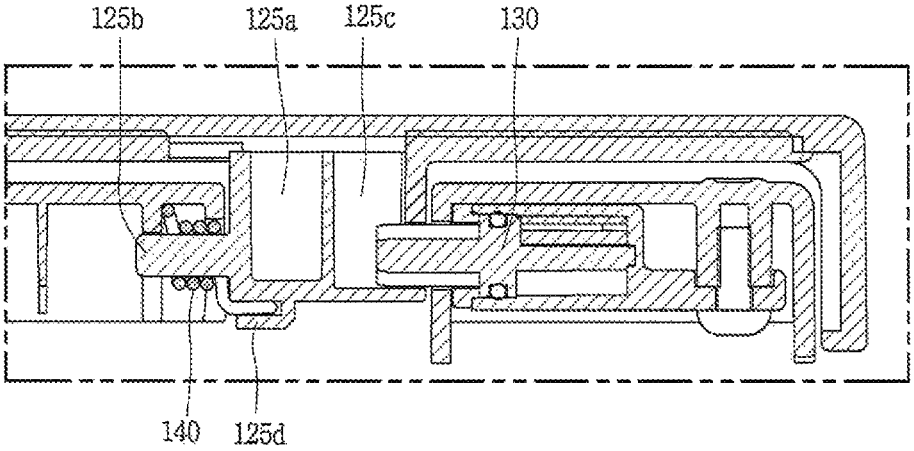
Figure 11:
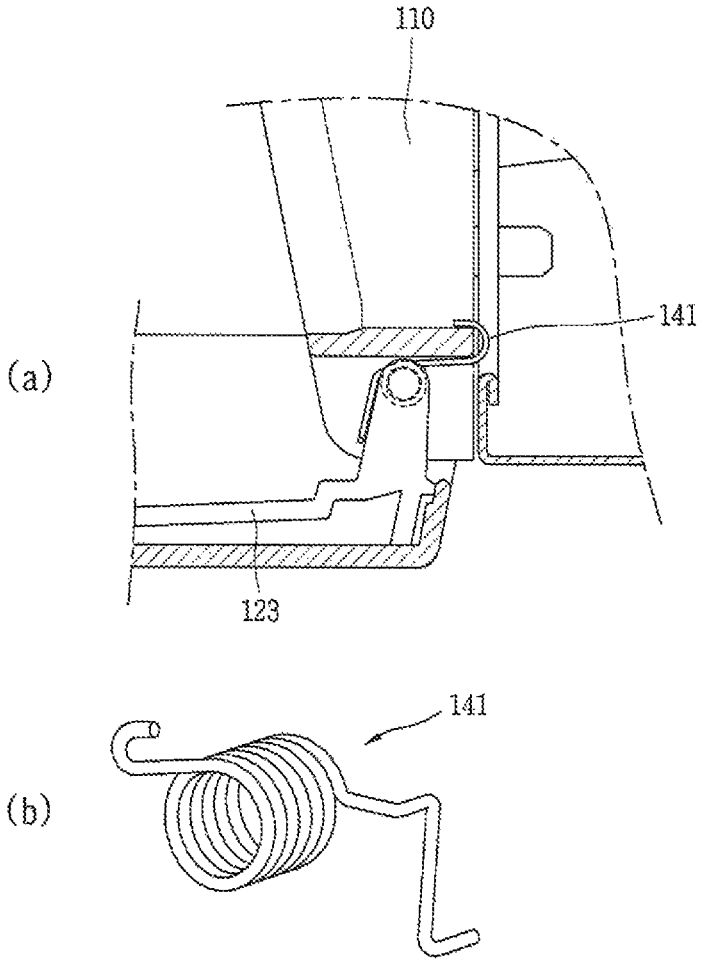
FIG. 11 illustrates a shape in which a cover portion is supported by a bracket due to a coil spring and an example of the coil spring.
Figure 12:
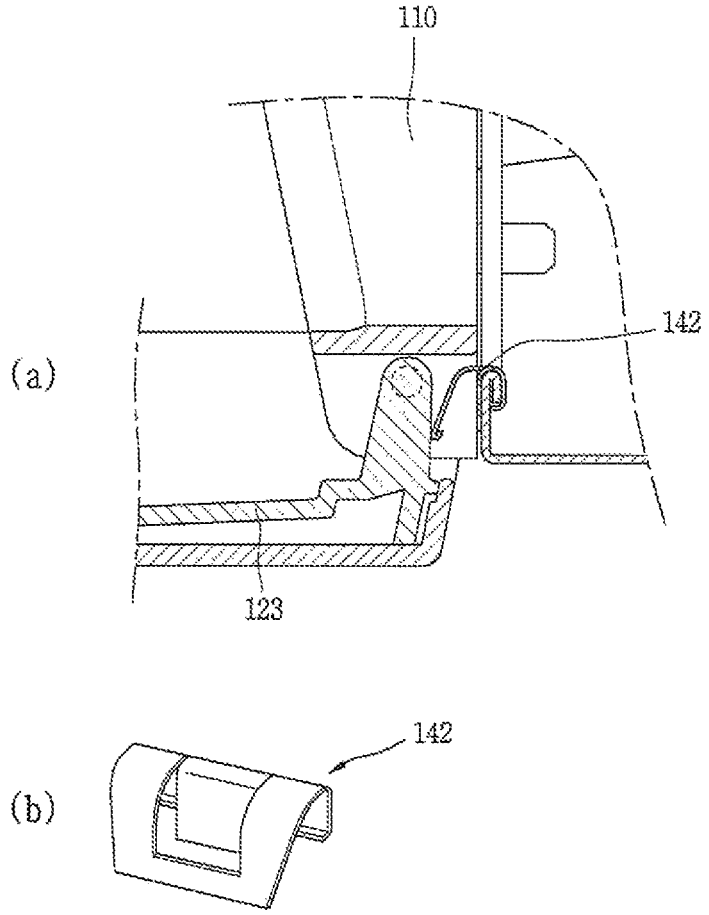
FIG. 12 illustrates a shape in which a cover portion is supported by a bracket due to a leaf spring and an example of the leaf spring.

Referring to FIG. 9, the hinge coupling portion 125 of the second member 123 constituting the cover 120 may be inserted into the hinge receiving portion 111 of the bracket 110, and a positional change of the elastic member 140 due to the rotation of the cover 120 can be seen with reference to the processes of (a), (b), and (c). The elastic member 140 may be supported by the bracket 110 and cover 120, respectively, and when the cover 120 rotates past a predetermined angle, the elastic member 140 may provide an elastic force acting in a direction opposite to a rotational direction of the cover 120. The elastic member 140 may support at least part of the cover 120 and bracket 110, thereby providing an elastic force.

The elastic member 140 may be inserted into the shaft protrusion 125*b* of the hinge coupling portion 125, and one end of the elastic member 140 may be fixed to the elastic member supporting portion 125*d* formed on the protruding portion 125*a* of the hinge coupling portion 125. A first end may be fixed to the elastic member supporting portion 125*d*, and a second end may be rotated past a predetermined angle, thereby being brought into contact with one side of the bracket 110 to provide an elastic force to limit the rotation of the cover 120. The elastic member 140 according to the present disclosure may denote a member of being displaced or deformed to have an elastic force, and denote a coil spring 141 or leaf spring 142.

The hinge coupling portion 125 may be located at the hinge receiving portion 111, and the elastic member 140 may be inserted into the shaft protrusion 125*b* of the hinge coupling portion 125, and one end of the shaft damper 130 may be accommodated through the shaft damper protrusion receiving portion 125*c* of the hinge coupling portion 125. The coil spring 141 may provide an elastic force to the detergent insert door while supporting one side of the cover 120 and bracket 110 in the above disclosed method. There is no particular limitation in the shape of a coil spring used in the present disclosure.

Even when the leaf spring 142 is used for the elastic member 140, the leaf spring 142 may support one side of the cover 120 and bracket 110 to perform the role of providing an elastic force to the detergent insert door 100, thereby performing the same function as that of the coil spring 141. The leaf spring 142 used in the present disclosure is merely an example, and the leaf spring 142 may have various shapes.

Figure 13:
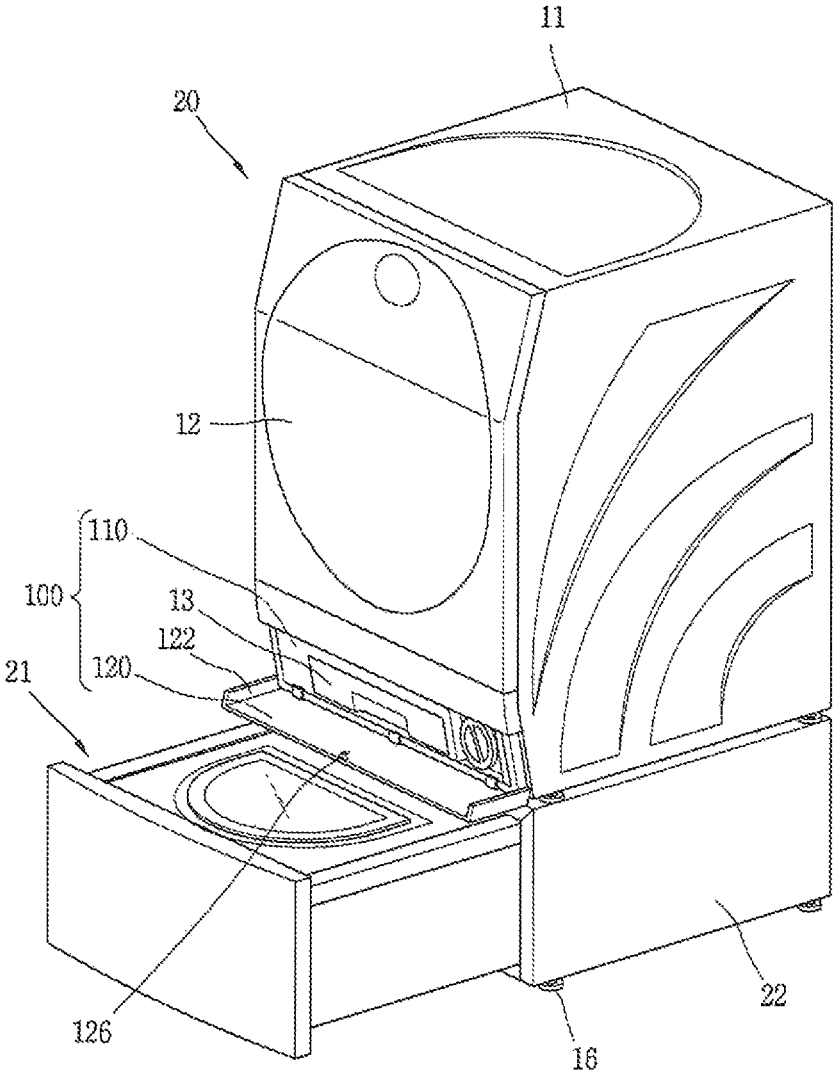
FIG. 13 is a perspective view illustrating a shape of a detergent insert door when a sub-drum is located at a lower portion of the body.
Figure 14:
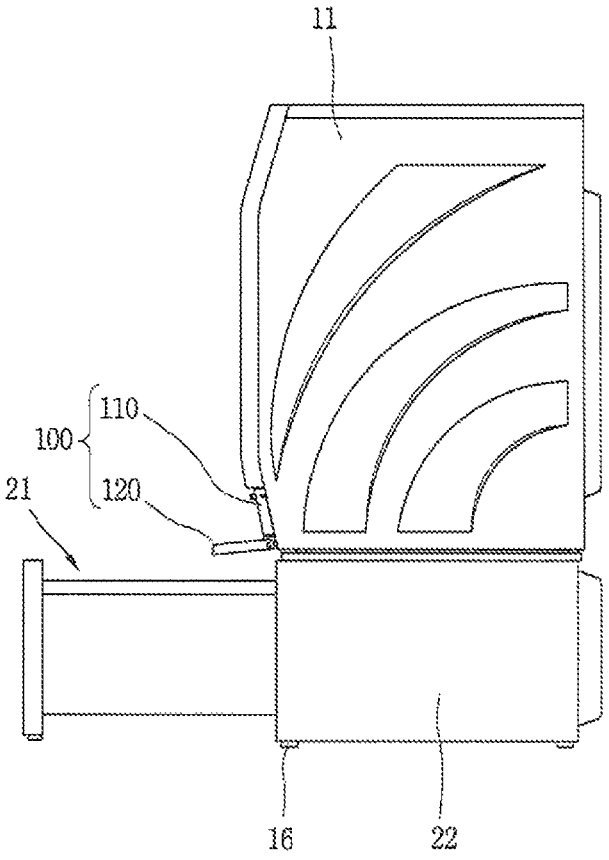

FIGS. 13 and 14 are views illustrating a shape in which a sub-drum is located at a lower portion of the body.

A laundry treating apparatus having the detergent insert door 100 according to the present disclosure may have the foregoing effects even in case where the floor is located at a lower portion of the body as well as an additional sub-drum 21 is located at a lower portion of the body. When an upper portion of the detergent insert door 100 rotates with respect to the detergent inlet to open the detergent inlet, the sub-drum 21 and the detergent insert door 100 may be separated from each other by a predetermined distance, thereby having an advantage of a laundry treating apparatus having the above-described detergent insert door 100.

A laundry treating apparatus having a detergent insert door according to an embodiment of the present disclosure may include a detergent container receiving portion provided at a lower portion of a body, and provided with a front opening portion to insert a detergent container; and a detergent insert door rotatably provided on a front surface of the detergent container receiving portion to open or close the detergent container receiving portion, wherein the detergent insert door includes a bracket coupled to the front opening portion to allow a detergent inlet formed on a front surface thereof to communicate with the front opening portion, and provided with a hinge receiving portion at a lower portion thereof; a cover inserted into the hinge receiving portion and coupled to the bracket to open or close the detergent inlet; a shaft damper coupled to a hinge shaft at one side of the bracket to limit a rotation speed of the cover up to a set angle; and an elastic member supported by the bracket and the cover to provide an elastic force in an opposite direction of rotation when the cover rotates above a set angle based on the bracket.

The cover may include a first member configured to form an appearance of the detergent insert door, and provided with bracket supporting portions protruded and formed toward the bracket at both ends thereof; and a second member adhered to a rear surface of the first member to reinforce a strength of the first member, and provided with the hinge shaft at a lower portion thereof. The bracket supporting portion may include a rotation protrusion protruded and formed toward a central portion of the first member at one side thereof, and formed to be accommodated into the bracket for the rotation of the cover.

The second member may include at least one or more hinge coupling portions protruded and formed toward the detergent container receiving portion at a lower portion thereof to be inserted into the hinge receiving portion. The hinge coupling portion may include a protruding portion inserted into the hinge receiving portion; a shaft protrusion supported by the bracket, and extended along a direction of the hinge shaft at one side of the protruding portion to insert the elastic member; and a shaft damper protrusion receiving portion configured in a groove shape and formed at the other side of the protruding portion to accommodate one end of the shaft damper.

The protruding portion may include an elastic member supporting portion configured in a groove shape to accommodate and support the elastic member at one side thereof. An end of the elastic member may be fixed to the elastic member supporting portion, and the other end thereof may be brought into contact with one side of the bracket due to rotation above a set angle of the cover to limit the rotation of the cover.

The hinge receiving portion may be configured in a depressed shape from the bottom to the top to hinge-couple the cover to the bracket. A cover supporting hole formed to support and rotate the cover may be provided at one side of the hinge receiving portion.

A shaft damper insert hole formed to allow the shaft damper to pass therethrough may be provided at the other side of the hinge receiving portion. The shaft damper may be coupled to the hinge coupling portion through the shape damper insert hole to limit a rotation speed of the cover. The elastic member may be either one of a coil spring and a leaf spring.

A ring portion protruded and formed to be coupled and fixed to the bracket may be provided at an upper end of the second member. An upper portion of the detergent insert door may rotate with respect to a hinge at a lower portion thereof to allow the opening of the detergent inlet, thereby inserting or withdrawing the detergent container into or from the detergent inlet.

The detergent insert door may rotate at a limited speed by a predetermined angle by the shaft damper, and then further rotation may be limited by the elastic member, thereby preventing it from being collided with the floor or the sub-drum. According to the present disclosure having the foregoing configuration, the detergent insert door may be located to be separated from the floor or the sub-drum by a predetermined distance even when the detergent insert door is rotated to open the detergent inlet, thereby allowing a user to easily hold and open or close the detergent insert door.

The configurations and methods according to the above-described embodiments will not be limited to the foregoing laundry treating apparatus having a detergent insert door, and all or part of each embodiment may be selectively combined and configured to make various modifications thereto.

Hereinafter, a laundry treating apparatus having a detergent insert door associated with the present disclosure will be described in more detail with reference to the accompanying drawings. Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a detergent container receiving compartment provided at a lower portion of a body, and having a front opening into which a detergent container may be inserted; and a detergent insert door rotatably provided on a front surface of the detergent container receiving portion to open or close the detergent container receiving compartment, wherein the detergent insert door includes:

a bracket coupled to the front opening portion to allow a detergent inlet formed on a front surface of the bracket to communicate with the front opening, and including a hinge receiving groove at a lower portion of the bracket;

a cover coupled to the hinge receiving groove and coupled to the bracket to open or close the detergent inlet;

a shaft damper configured to limit a rotation speed of the detergent insert door; and a spring configured to provide an elastic force in an direction opposite to a rotation of the detergent insert door, when the detergent insert door rotates past a set angle with respect to the bracket to support the cover so as to restrict the cover from touching the floor, wherein the cover includes:

a first member that forms an appearance of the detergent insert door and includes bracket supports at both ends thereof; and a second member adhered to a rear surface of the first member to reinforce the first member, and including a hinge shaft at a lower portion of the second member.

2. The laundry treating apparatus of claim 1, wherein the bracket supports each include a rotation protrusion protruding toward a center of the first member, and configured to be accommodated into the bracket to rotate the cover.

3. The laundry treating apparatus of claim 2, wherein a cover supporting hole formed to support and rotate the cover is provided at a first side of the hinge receiving groove.

4. The laundry treating apparatus of claim 1, wherein the second member includes at least one hinge protruding toward the detergent container receiving compartment at a lower portion of the second member to be inserted into the hinge receiving groove.

5. The laundry treating apparatus of claim 4, wherein the at least one hinge includes:

a housing inserted into the hinge receiving groove;

a shaft supported by the bracket, and extended along a direction of the hinge shaft at a first side of the housing to receive the spring; and a shaft damper protrusion receiving socket configured in a groove shape and formed at a second side of the housing to accommodate one end of the shaft damper.

6. The laundry treating apparatus of claim 5, wherein the housing includes an elastic member supporting notch configured in a groove shape to accommodate and support the spring at one side of the housing.

7. The laundry treating apparatus of claim 5, wherein a first end of the spring is fixed to the elastic member supporting notch, and a second end thereof is brought into contact with one side of the bracket due to rotation past a set angle of the cover to limit the rotation of the cover.

8. The laundry treating apparatus of claim 7, wherein a shaft damper insert hole formed to allow the shaft damper to pass therethrough is provided at a second side of the hinge receiving groove.

9. The laundry treating apparatus of claim 1, wherein the hinge receiving groove is depressed from a bottom to a top of the bracket to hinge-couple the cover to the bracket.

10. The laundry treating apparatus of claim 9, wherein the shaft damper is coupled to the at least one hinge through the shaft damper insert hole to limit a rotation speed of the cover.

11. The laundry treating apparatus of claim 1, wherein the spring is either one of a coil spring and a leaf spring.

12. The laundry treating apparatus of claim 1, wherein a hook is provided at an upper end of the second member to be coupled to and fixed to the bracket.

* * * * *